United States Patent [19]

Osborn et al.

[11] Patent Number: 4,857,039

[45] Date of Patent: Aug. 15, 1989

[54] FLEXIBLE MATERIAL FOLDING APPARATUS

[75] Inventors: Paul V. Osborn, Webster, N.Y.; Clyde C. Tendick, Jacksonville, Ill.

[73] Assignee: Mobil Oil Corporation, New York, N.Y.

[21] Appl. No.: 99,277

[22] Filed: Sep. 21, 1987

[51] Int. Cl.[4] ..... B31F 1/00

[52] U.S. Cl. ..... 493/416; 493/418; 493/437; 493/441; 493/444

[58] Field of Search ..... 493/422, 416–418, 493/423, 437, 441, 451, 250, 256, 444; 271/195

[56] References Cited

U.S. PATENT DOCUMENTS

| | | | |
|---|---|---|---|
| 2,709,585 | 5/1955 | Abell et al. | 493/441 |
| 2,759,726 | 8/1956 | Sommerhalter | 493/444 |
| 3,467,370 | 9/1969 | Grantham | 493/441 |
| 3,927,875 | 12/1975 | Winnemoller et al. | 493/418 |
| 4,109,902 | 8/1978 | Barrer | 493/444 |
| 4,419,088 | 12/1983 | Nemec | 493/444 |

FOREIGN PATENT DOCUMENTS

| | | | |
|---|---|---|---|
| 1238490 | 4/1967 | Fed. Rep. of Germany | 493/437 |

*Primary Examiner*—Frederick R. Schmidt
*Assistant Examiner*—Robert Showalter
*Attorney, Agent, or Firm*—Alexander J. McKillop; Charles J. Speciale

[57] ABSTRACT

A mechanical folding device fires a multiplicity of pins through an air table and a multiplicity of parallel endless belts forming the conveyor to lift a flexible foldable length of material, such as a plastic film bag body, into a catching device such as a pair of nip conveyors carrying sets of folding belts for completing the fold and carrying the length of material away from the first conveyor. The pins are fired through the air table and conveyor belts by means of a torsion bar coupled by means of lever arms to a carriage carrying the pins. The torsion bar is mechanically loaded by a first air cylinder while the carriage is locked in a lowered position. When the carriage is released by a second air cylinder, the torsion bar first accelerates the carriage upward then decelerates the carriage during the upper half of the extension of the pins. The bar forces the pins to return to a retracted position within the air table.

18 Claims, 5 Drawing Sheets

FLEXIBLE MATERIAL FOLDING APPARATUS

FIELD OF THE INVENTION

This invention relates to a folding apparatus and, in particular, to an apparatus for folding a length of flexible material such as a plastic film bag delivered from a conveyor.

BACKGROUND OF THE INVENTION

In the manufacture of plastic film bags it is desirable to provide an apparatus for folding plastic bags at least 24 inches wide and 42 inches long delivered from a conveyor at a high rate of speed to minimize production cost. It has been known to transfer plastic bags from a continuous moving conveyor into the nips of an adjoining set of folding belts by means of an air blast fired through the first conveyor which lifts and folds the bag from the first conveyor and into a pair of nips. Such a system lacks the positive mechanical reliability associated with the use of solid mechanical members contacting the bag for movement.

The present invention provides for the folding of 24 inch wide bags at 135 bags per minute.

SUMMARY OF THE INVENTION

It is an object of the invention to provide an apparatus suitable for relatively high speed folding of lengths of flexible, foldable materials, such as plastic film bags.

It is another object of the invention to provide a high speed mechanical folder.

These and other objects of the invention are accomplished by an apparatus which includes a first conveyor for moving a length of flexible, foldable material to a mechanical lifting device at least partially extendable through the first conveyor for at least partially raising and folding the length of flexible foldable material. The lifting device is coupled with a spring device which drives the mechanical lifting device at least partially through the first conveyor to lift and crease the flexible material.

It is another object of the invention to rapidly withdraw the lifting device from extension through the conveyor.

It is another object of the invention to simplify the construction of the folding apparatus.

These and other objects ar accomplished by another important feature of the invention. The lifting device is coupled with the spring device so that it is decelerated and driven back through the conveyor to its initial position to prepare for folding the next length of material by the spring device.

According to yet another important feature of this aspect of the invention, the spring device is a torsion member. A first lever has a end attached to the torsion member and a first range of angular movement around the torsion shaft for initially loading the torsion shaft while second lever is fastened to the torsion member and has another end coupled with the lifting device. The second lever has a second range of angular movement about the torsion shaft greater than the first angular range so that the second lever can travel through a greater angular arc around the torsion member thereby reverse loading the torsion device and decelerating the lifting device.

Another important aspect of the folding apparatus which assists high speed plastic bag folding operations is the provision of an air table adjoining the conveyor.

The lifting mechanism operates through the air table as well as through the conveyor. Preferably a vacuum is applied at one end of the table initially receiving a plastic bag and a positive air pressure is supplied to the bag in the vicinity of the lifting device to assist in removing the bag from the conveyor.

These and other aspects of the invention will become apparent upon a review of the accompanying drawings and the following detailed description of the invention.

DETAILED DESCRIPTION OF THE INVENTION

The following invention can be incorporated into a draw tape bag line, for example, of the type described in U.S. Pat. No. 4,624,654 Boyd et al, assigned to the assignee of this application and incorporated by reference, or a comparable bag line.

Figure 1:
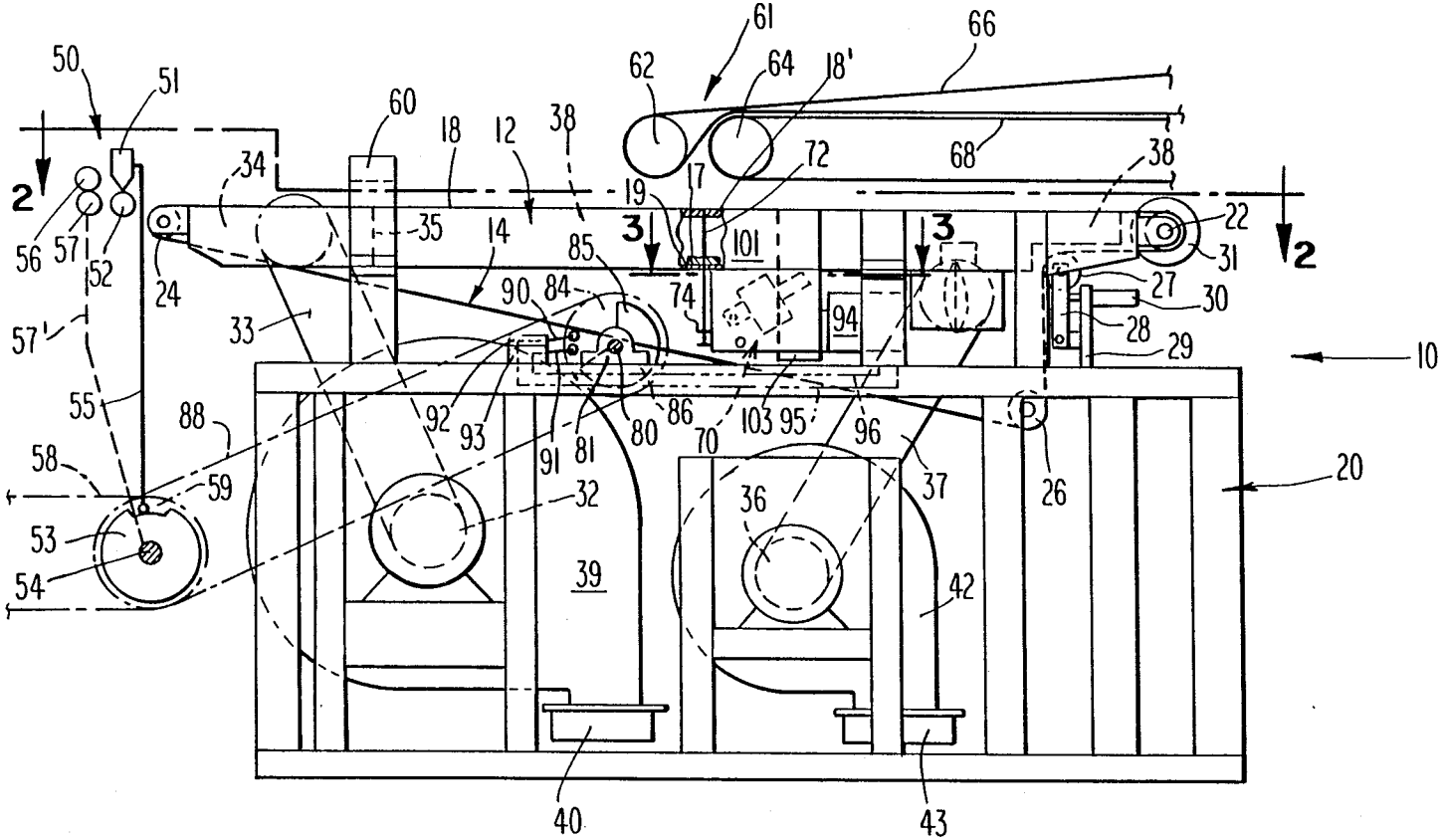
FIG. 1 is a side elevation view of an air table with a continuous conveyor employing the folding mechanism of the subject invention and positioned adjoining the outlet end of a bag machine.
Figure 2:
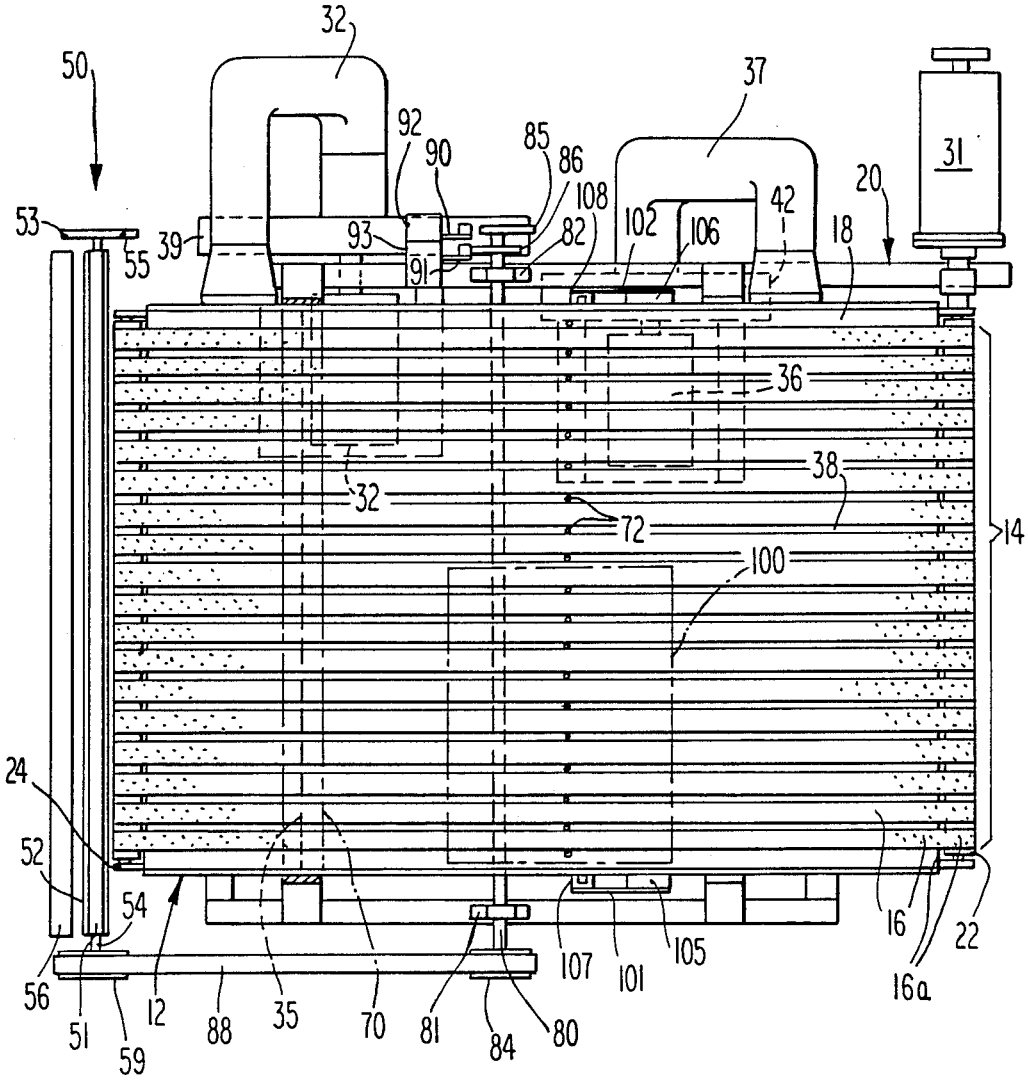
FIG. 2 is a plan view of FIG. 1 taken along the lines 2—2 in FIG. 1.

FIGS. 1 and 2 illustrate a plastic film handling apparatus including an air table assembly 10 incorporating the folding mechanism of the subject invention. The apparatus 10 is used in connection with a conventional bag manufacturing machine such as an Amplas Model No. 1402, indicated diagrammatically at 50. Referring to FIGS. 1 and 2, the apparatus 10 includes an air/-vacuum table or box 12 over which passes a continuous conveyor 14, FIG. 2, comprising a plurality of endless, parallel, spaced, rubberized perforated belts 16. The box 12 and other components are supported on a frame 20. The belts 16, FIG. 2, travel from left to right across an upper vacuum surface 18 of the box 12 between an idler roller 24 and a driven roller 22, each supported at opposite ends of the box 12.

As shown in FIG. 1, another idler roll 26 is supported on the frame 20 beneath the air table 12 and directs the endless belts 16 of the conveyor 14 from driven roll 22 to the idler roller 24. After the belts 16 of the conveyor 14 leave the driven roll 22 they pass over a corresponding plurality of individual pulleys 27 (only one visible in FIG. 1). Each pulley 27 is supported on a pivotally mounted arm 28 on a vertical member 29 of frame 20 and pressed against an individual belt 16 by an air cylinder 30 for adjusting belt tension. An indexing rotary drive unit 31 drives roller 22. A first blower 32, supported on frame 20, is coupled by means of a plenum 33 to a first chamber 34 within the box 12 to the left of an internal partition, indicated by broken line 35. A second blower 36, supported on frame 20, is coupled by a plenum 37 to a second chamber 38 formed within the box 12 to the right of the partition 35. A second plenum 39, coaxial with an end of plenum 33, is coupled with blower 32 and supports a muffler/air filter assembly 40. A second plenum 42, coaxial with an end of plenum 37, is coupled with the second blower 36 and also supports a muffler/air filter assembly 43. The upper surface 18 is provided with elongated narrow slots which extend the length of the table 12 and underlie openings 16a in the belts 16, FIG. 2, and allow the air pressure developed in the chambers 34 and 38 of the table to be applied to a plastic bag 100 (indicated in phantom in FIG. 2) on the belts 16.

Still referring to FIGS. 1 and 2, the air table assembly 10 is positioned adjoining the output end of a conventional bag machine 50 such as the Amplas Model No. 1402, only salient features of which are diagrammatically indicated in the figures. The bag machine 50 includes a heated sealer/cutter bar 51 reciprocated against an anvil in the form of a roller 52 by suitable means such as a cam 53 mounted to a main shaft 54 and a mechanical linkage indicated by line 55. A pair of nip rolls 56 and 57, are operated as diagrammatically shown by broken line 57' in synchronization with the bar 51 to index or advance a bag width or bag length of continuous plastic bag forming film between the sealer/cutter bar 51 and roller anvil 52. The main shaft 54 is driven by a motor, not shown, coupled by a belt 58 to a double pulley 59 fixed to the shaft 54.

Referring to FIG. 1, in the preferred mode of operation, a static bar 60 is supported on vertical side members of the frame 20 above the partition wall 35 and develops a static charge of 15,000 to 20,000 KV on plastic bag bodies passed between it and the air table surface 18 to electrostatically attract the bag bodies to the grounded metal plates forming the upper surface 18. A vacuum is applied to first chamber 34 in the air box 12 adhering plastic bags onto the belts 16 of conveyor 14. A positive air pressure is applied in the adjoining chamber 38 to assist in lifting the electrostatically charged bags from the conveyor 14.

Referring again to FIG. 1, directly above the upper surface 18 is a folding belt assembly 61 formed by a pair of adjoining nip rolls 62 and 64 each supporting a set of continuous belts 66 and 68, respectively. The belts 66 loop around roll 62 and also pass over a portion of roll 64 to form a draw conveyor. The belts 66 and 68 are aligned to match the spacing of the belts 16 of the vacuum table 12.

Figure 4:
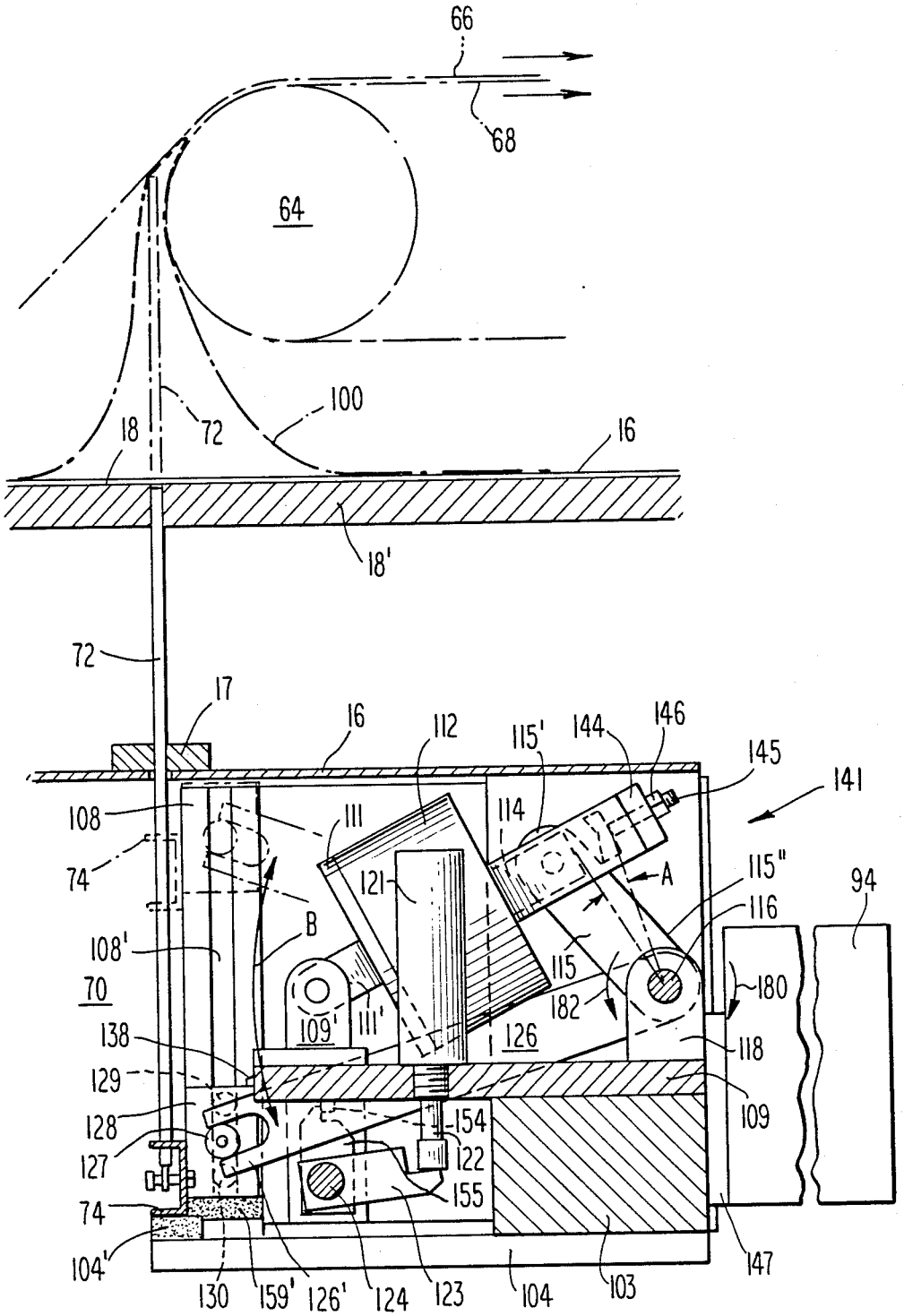
FIG. 4 is a partial sectional view taken along the lines 4—4 in FIG. 3.

Still referring to FIG. 1, the mechanical fold mechanism of the subject invention, referred to generally herein by reference numeral 70, is partially depicted. The mechanism 70 includes a multiplicity of elongated pins 72, which are supported in common from a carrier 74 in the form of a channel section positioned beneath the vacuum table 12. Each pin 72 extends through the air table 12 and upper surface 18 between the adjoining belts 16 (FIGS. 1, 2 and 4). The carrier 74 and supported pins 72 are mechanically raised in a manner subsequently described to at least crease and partially lift a bag body 100 lying on the belts 16 over the pins 72 between rolls 62, 64 and between the belts 66 and 68. Each of the pins 72 passes through a bore in a lower wall 19 and the upper wall 18' of air box 12. A pin guide block 17 is attached to the lower wall 19 over each pin 72 and is bored to receive the pin. The belts 66 and 68 frictionally engage the creased bag body, complete the fold and carry away the once folded bag body to a packing machine to the right of the apparatus 10,(not shown) which further folds the once folded bag body and stacks folded bag bodies for packing.

Referring to FIGS. 1 and 2 there are shown additional components of the system controlling the operation of the folding mechanism 70. An axle 80 is supported between horizontal members of the frame 20 in bearing blocks 81, 82 and supports at one end a pulley 84 and a pair of cams 85 and 86. The pulley 84 is coupled to the pulley 59 supported on main shaft 54 of the bag machine 50 by a belt 88. Each of the cams 85 and 86 controls the operation of a lever arm 90 and 91 of separate three-way valves 92, 93, respectively, also supported on the frame 20 adjoining the cams. The valve 93 is coupled with a four-way valve 148 positioned within a housing 94 beneath table 12. Fluid lines between the two valves 92, 93 and the housing 94, each indicated diagrammatically in FIG. 1 by broken lines 95, 96, connect each of the valves 92, 93 respectively with the valve 148 in housing 94 and an air cylinder 121. The valves 92, 93 and 148 enable and control the upward firing of pins 72 in conjunction with indexing operation of the bag machine 50. The indexing operation of the conveyor 14 of air table 12 is controlled by the rotary drive unit 31 in coordination with the operation of the bag machine 50. Further details of this operation are described in related patent applications Ser. No. 099,276, filed herewith entitled, "Hydraulic Index Drive System", and Ser. No. 099,278, entitled, "Flexible Coupling", assigned to the assignee of this application and incorporated by reference. The air table 12 is the subject of related patent application Ser. No. 099,275, filed herewith, entitled, "Plastic Film Air Table Conveyor", assigned to the assignee of this application and incorporated by reference.

Some of the structural members supporting the first fold mechanism 70 beneath the air table 12 can be seen in FIGS. 1 and/or 2. A side member 101 and support block 103, FIG. 3, spanning the underside of table 12 between member 101 and a like member (102 in FIG. 2) can be seen in FIG. 1. Spacers 105 and 106 and cam guide blocks 107 and 108, also attached to the side members 101, 102, respectively, above block 103, FIG. 1, can be seen in FIG. 2.

Figure 3:
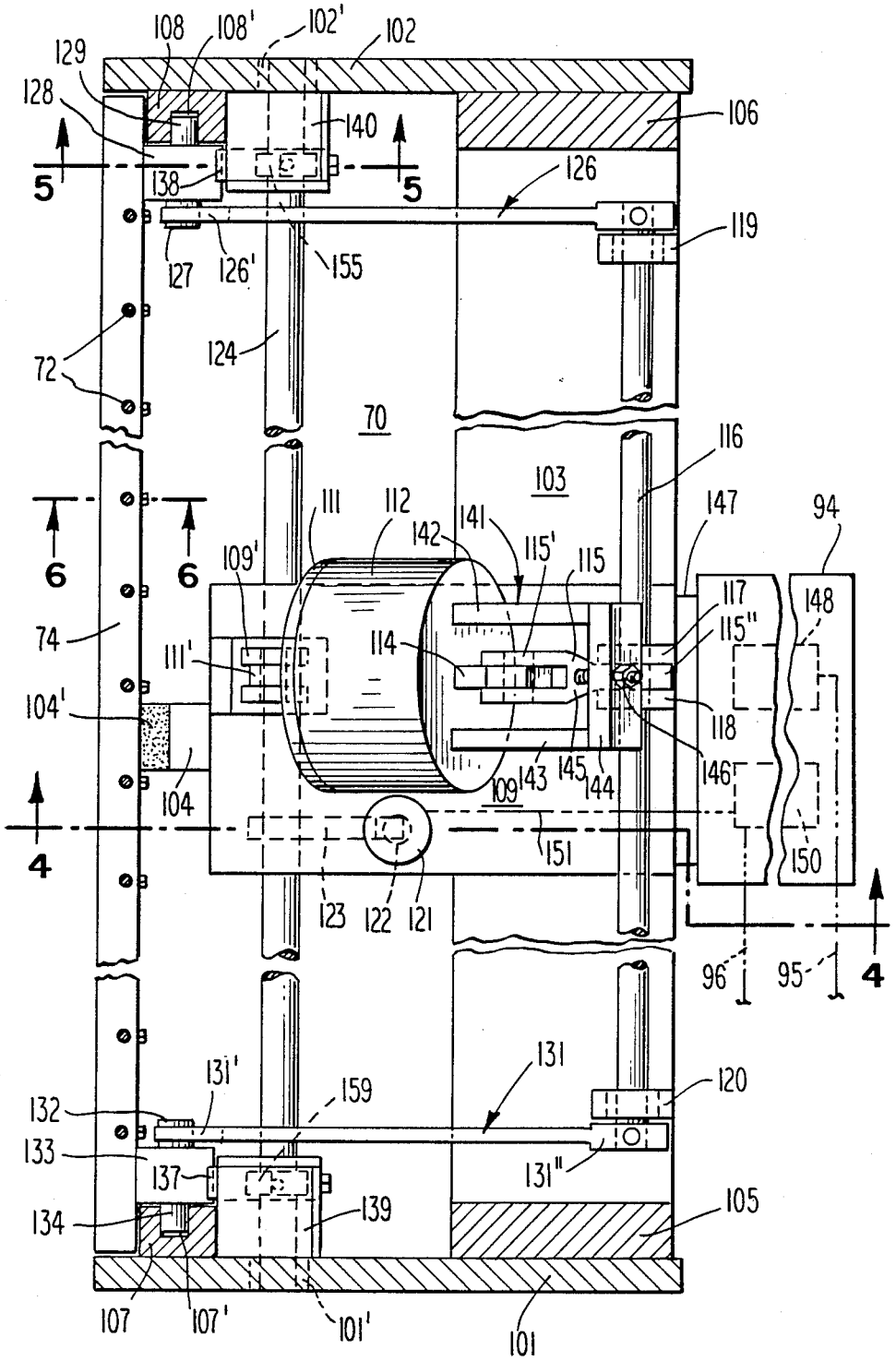
FIG. 3 is a diagrammatic plan view of the folding mechanism mounted beneath the air table of FIGS. 1 and 2.

FIGS. 3 and 4 are plan and side section views, respectively, of the fold mechanism 70 mounted beneath the table 12. A support plate 109 is mounted by suitable means such as bolts or welding (not shown) to the top of support block 103. Another plate 104 is mounted to the bottom surface of block 103 by suitable means (not shown) and mounts a bumper 104' of polyurethene or other suitable material for cushioning pin carrier 74 at the bottom of its downward stroke. A clevis 109' protruding from the upper surface of the support plate 109, FIG. 4, receives a flange 111' extending from a mounting plate 111 attached to one side of a pancake air cylinder 112, rigidly positioning the air cylinder 112 to the plate 109. A bell crank linkage is formed by cylinder piston rod 114 and a lever arm 115. The piston rod 114 is received in a clevis 115' at one end of the lever arm 115. The other end 115" is clamped to a torsion bar 116. The torsion bar 116 is supported by two pillow blocks 117, 118, FIG. 3, which are attached to the upper surface of the support plate 109, and two more pillow blocks 119 and 120, which are attached to the upper surface of block 103. A second air cylinder 121 is mounted to the support plate 109 adjoining cylinder 112.

Referring to FIG. 3, coupled at either end of the torsion shaft 116 are the ends of elongated lever arms 126 and 131. As shown in FIGS. 3 and 4, a clevis 126' in the opposing end of the lever arm 126 receives a pin 127 mounted in a cam block 128, itself fastened with the pin carriage 74 at an edge of the carriage. A pair of cylindrical cam followers 129 and 130 (indicated in phantom in FIG. 4) extend from an opposing side of the block 128 into a slot 108 in guide block 108. The second arm 131, FIG. 3*a* is fixedly mounted at one end 131" to the remaining end of the torsion shaft 116 and receives in a clevis 131' at its opposing end a pin 132 mounted to a cam block 133. The cam block 133 supports on its opposing side two additional cam followers, one of which 134, can be seen in FIG. 3. The additional cam followers are received in a slot 107' in the guide block 107. A pair of latches 137, 138 positioned in housings 139, 140, respectively, attached to guide blocks 107, 108, respectively, engage upper surfaces of the cam blocks 133 and 128, respectively. The latches 137, 138 lock the locks 133, 128 in their lowermost position in slots 107' and 108', respectively, allowing the torsional loading of shaft 116 by piston 112.

Also shown in FIG. 3 is a piston stop assembly 141 formed by a pair of identical brackets 142 and 143 bolted to the piston rod surface of the pancake air cylinder 112. A stop bar 144 is bolted to the upper, distal ends of each of the brackets 142, 143. The assembly 141 stops the outward motion of the cylinder piston rod 114. A threaded stud 145 and locknut 146 provide an adjustment for the stroke of the piston rod 114.

The housing 9 is mounted to the support plate 109 and support block 103 through a spacer 147. The housing 94 contains the four-way valve 148 coupled with the pancake cylinder 112 by a pair of fluid lines, omitted from the figures for clarity. The valve 148 is controlled by the three-way valve 93 (FIG. 1) through line 95. The three-way valve 92, is coupled with the air cylinder 121 by the single fluid line 96. The air cylinder 121 is spring-loaded in the piston arm retracted position. Thus it will be seen that the pancake cylinder 112 is double acting, i.e., pressurized on either side of its piston.

Figure 5:
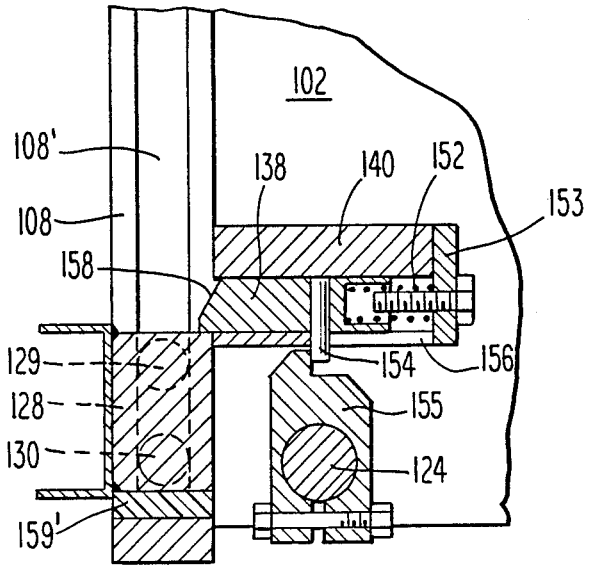
FIG. 5 is a partial sectional view of the trigger mechanism taken along the lines 5—5 in FIG. 3.

The operation of the device shown in FIGS. 3–5 will now be described. Under the control of the four-way valve 148, the pancake air cylinder 112 is first pressurized forcing piston rod 114 outward applying a torque to the torsion shaft 116 through lever arm 115, rotating the shaft in the direction of arrow 180 (FIG. 4). The torsion load applied by the air cylinder 112 urges the two lever arms 126 and 131 upward. The latches 137 and 138 hold the cam blocks 128 and 133 in their lowermost position thereby holding the carriage 74 locked in the down position. When energized by the three-way valve 92, the second cylinder 121 extends piston rod 122 which engages the lever arm 123 causing shaft 124 to rotate (clockwise in FIG. 4) withdrawing the latches 137 and 138 into the housings 139, 140. The released blocks 128, 133 are forced upward by the lever arms 126, 131. As seen in FIG. 4, the angular range of motion A of the loading arm 115 driven by the pancake cylinder 112 around torsion shaft 116 is much less than the angular range of motion B around shaft 116 available to the lever arms 126, 131. The rising lever arms 126 and 131 reverse load the torsion shaft 116, beginning about half way through their upward motion, decelerating the pins 72 to a complete stop. The rising pins 72 lift and centrally crease a bag body 100 lying on the conveyor belts 16 centered over the pins 72. The pins 72 have sufficient momentum to carry sufficiently high so that a bag 100 is frictionally captured between the rolls 62, 64, by the belts 66 and 68 which complete the fold of the bag 100 and carry it away. The reverse loaded torsion bar 116 now forces the lever arms 126, 131 and carriage 74 downward, withdrawing the pins 72 into the table 12. The pancake cylinder 112 is oppositely loaded by the four-way valve 148, withdrawing piston rod 114, forcing the shaft 116 to rotate in the counterclockwise direction of arrow 182 (FIG. 4), in turn forcing the lever arms 126, 131 and carriage 74 downward until the guide blocks 128 and 133 are again engaged by the latches 138, 137 respectively. The four-way valve 148 pressurizes the cylinder 112 to extend piston arm 114 and the process is repeated.

The second air cylinder 121 and latches 137, 138 are part of a trigger mechanism for releasing the cam locks 128 and 133, allowing the pins 72 to be driven through the air table 12. When actuated by valve 92, the second air cylinder 121 extends its piston arm 122 downward causing the lever arm 123 firmly attached to the shaft 124, beneath the platform 109, to rotate in a clockwise direction. The shaft 124 is supported by journal bearings 101', 102' inside plate members 101, 102, respectively FIG. 3. Attached near either end of shaft 124, beneath the latches 137, 138 are lever arms 159 and 155, respectively, which engage the opposing latch in the manner indicated in FIG. 5 with regard to arm 155 and latch 138. FIG. 5 shows in detail the mechanical linkage between the shaft 124 and the latch 138. The linkage between the latch 137 and the shaft 124 is identical. The latch 138 is biased out of the housing 140 and into engagement with the upper surface of the cam block 128 by means of a coil spring 152 between the latch 138 and an adjustable latch stop 153 at the rear of the housing 140. A pin 154 fixed in the latch 138 extends downwardly through a slot 156 in the bottom of the housing 140. The pin 154 engages with a lever arm 155 fixed to the shaft 124. The pressurization of the second air cylinder 121 causes the lever 123 to rotate the shaft 124 rotating the lever 155 clockwise withdrawing the latch 138 into the housing 140 thereby releasing the cam block 128. Beveled surface 158 is provided on the exposed, upper side of the latch 138 to allow the latch to be pushed back into the housing 140 by the downward motion of cam block 128. Mounted to the bottom of the guide block 108 is a bumper 159' which receives and cushions the downward impact of the cam block 128. The bumper 159 can be made of any suitable cushioning material such as polyurethene.

Figure 6:
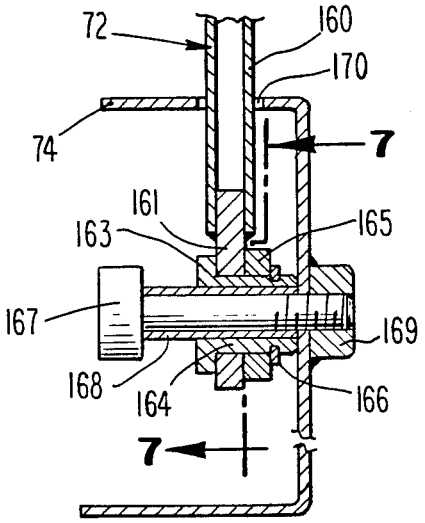
FIG. 6 is a partial sectional view of the pin driving system taken along the lines 6—6 in FIG. 3.
Figure 7:
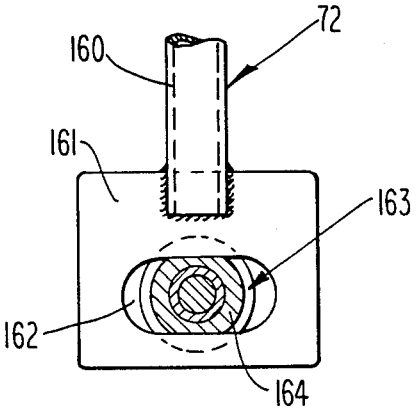
FIG. 7 is a partial sectional view of a folding pin taken along lines 7—7 in FIG. 6.

FIGS. 6 and 7 show details of the mounting of the individual pins 72. Each pin 72 includes a tubular shaft 160 fixed to a rectangular plate 161. As is best seen in FIG. 7, the plate 161 is provided with an elongated horizontal opening 162 to allow lateral adjustment of the pin 72. A sleeve 163 having a similarly elongated collar 164 is passed through the elongated opening 162 and held in place by means of a washer 165 and a snap ring 166. A shoulder screw 167 is passed through a cylindrical bushing 168 into nut 169 and holds the pin 72 and assembly 163–166 to the carriage 74. The top flange of the C-member forming the carriage 74 is similarly provided with elongated slots 170 (see FIG. 6).

The above described folding apparatus was designed to lift the middle of a thermoplastic bag 100 a height of four inches above the conveyor 14 and across the 42" bag length in 100 milliseconds and retract to the extension of the pins 72 above the vacuum table 12 in an addition 200 milliseconds. The timing is dictated by the requirement of making 135 bags of 24" bag width per minute. The present invention meets this criteria with a 62 ms. upstroke leaving 238 ms. for the downstroke. From the foregoing description it will be seen that the air cylinder 112 releases the stored up energy in the torsion shaft 116 at the start of the fold operation which through the bell crank linkage including the cylinder piston rod 114 and the lever arm 115 raises the pins 72 located between the vacuum belts 16, the four inches required for the folder belts 66, 68 to grab the bag. There is little shock in the system since the torsion shaft 116 is at neutral at the midpoint of the stroke and wind up in the reverse direction stores up pin momentum energy. With this arrangement there is more time for the downstroke and the shock is absorbed by the polyurethene bumpers. In one embodiment of the invention only approximately 60 ms. was required for the upstroke leaving approximately 240 ms. for the downstroke. An initial 50 lbs. force on the 4 lb. moving system comprising the pins 72, carriage 74 and Cam blocks 128, 123 resulted in a 12G peak acceleration.

The above described folding apparatus has numerous advantages. The mechanism 70 is compact and readily fits beneath the air table 12 above the return side of the conveyor belts 16. This facilitates belt replacement and minimizes the length of the belts which in turn minimizes inertia loads on the air table index drive 30. The present system is adapted to handle a range of bag sizes by having two fold locations on the vacuum table about twelve inches apart. Thus the mechanical fold mechanism 70 may be moved to a second location spaced from the first location on the vacuum table 12 for folding the plastic bags in the same manner as previously described. It is also to be understood that an air manifold may be provided in the air table 12 such that air can be directed out of the top of the hollow pins 72 and against the plastic bag to assist in inserting the bag between the belts 66 and 68.

Although a preferred embodiment of the invention has been described and illustrated, it will be understood that other modifications may be made without departing from the spirit and scope of the invention as set forth in the appended claims.

What is claimed is:

1. A mechanical folder apparatus comprising:

an air table;

first conveyor means encircling the air table for receiving a length of flexible foldable materials;

mechanical lifting means extending through the air table and at least partially extendable through said first conveyor means for at least partially raising and folding a length of flexible foldable material from said first conveyor means;

spring coupled with said lifting means for driving said mechanical lifting means at least partially through said first conveyor means into a length of flexible foldable material on the conveyor means;

locking means for holding said mechanical lifting means within said first conveyor means;

means for loading said spring means in a direction to move said mechanical lifting means through the first conveyor means;

means for releasing said locking means; and second conveyor means opposite and spaced from said first conveyor means and opposite said mechanical lifting means for catching a length flexible foldable material raised by said mechanical lifting means.

2. The apparatus of claim 1 wherein said spring means comprises a torsion shaft.

3. The apparatus of claim 1 wherein said air table supports said first conveyor means and applies a positive air pressure greater than atmospheric air pressure through said first conveyor means.

4. The apparatus of claim 3 wherein said first conveyor means comprises a plurality of endless belts surrounding said air table said lifting means and said torsion shaft.

5. The apparatus of claim 1 wherein said spring means further decelerates the lifting means driven through the first conveyor means.

6. The apparatus of claim 1 wherein said first conveyor means comprises a plurality of endless belts spaced from one another and wherein said lifting means comprises a plurality of pins and a carriage supporting said plurality of pins so as to extend through spaces between the plurality of belts.

7. The apparatus of claim 6 wherein said spring means comprises a torsion member and further comprising:

lever arm means fixed to the torsion member and coupled with the pin carriage for moving the carriage with said torsion member.

8. The apparatus of claim 7 further comprising:

a reversible air cylinder means for moving a cylinder piston arm to either of two positions; and linkage means for coupling said piston arm with said torsion member.

9. The apparatus of claim 8 wherein in said linkage means has a range of angular motion around the torsion member less than a range of angular motion around the torsion member available to the lever arm means.

10. A mechanical folder apparatus comprising conveyor means for receiving a length of flexible foldable material, said conveyor means comprising a plurality of endless belts spaced from one another;

mechanical lifting means at least partially extendable through said conveyor means for at least partially raising and folding a length of flexible foldable material from said conveyor means, said lifting means comprising a plurality of pins and a carriage supporting said plurality of pins so as to extend through spaces between the plurality of belts;

spring means coupled with said lifting means for driving said mechanical lifting means at least partially through said conveyor means into a length of flexible foldable material on the conveyor means, said spring means comprising a torsion member;

lever arm means fixed to the torsion member and coupled with the carriage for moving the carriage with said torsion member;

a reversible air cylinder means for moving a cylinder piston arm to either of two positions;

linkage means for coupling said piston arm with said torsion member, said linkage means having a range of angular motion around the torsion member less than a range of angular motion around the torsion member available to the lever arm means;

locking means for locking said carriage to resist rotation of the torsion member by the linkage means; and trigger means actuating the locking means for releasing the carriage.

11. The apparatus of claim 10 wherein said trigger means comprises a second air cylinder means.

12. A method of folding a length of flexible material comprising the steps of:

(a) adhering a length of flexible material on a first conveyor;

(b) moving the length of flexible material on the first conveyor;

(c) spring firing a mechanical lifting member through the first conveyor into the length of flexible material at least partially folding and raising the length of flexible material from the first conveyor, said spring firing step including the sub-steps of:

(i) loading a torsion member in a first direction; and (ii) releasing the loaded torsion member through the lefting member; and (d) catching the raised material in a second conveyor.

13. The method of claims 12 further comprising the step of:

spring stopping the spring fired lifting member.

14. The method of claim 13 wherein said spring firing and spring stopping steps are performed by the same spring member.

15. The method of claim 12 further comprising the step of:

reloading the torsion member with the lifting member in a direction opposite the first direction.

16. The method of claim 12 further comprising the step of:

stopping the lifting device with the torsion member.

17. A plastic film bag folding apparatus comprising:

an air table;

first conveyor means encircling the air table for receiving a plastic film bag;

mechanical lifting means for at least partially raising and folding a plastic film bag from said first conveyor means, said mechanical lifting means comprising a multiplicity of pins extending through the air table and being extendable through said conveyor means;

a torsion member linked with said multiplicity of pins for driving said multiplicity of pins at least partially through said first conveyor means into a plastic film bag on the first conveyor means;

locking means for holding said multiplicity of pins within the conveyor means;

means for loading the torsion member in a direction to move the multiplicity of pins through the conveyor means; and means for releasing said locking means.

18. A plastic film bag folding apparatus in accordance with claim 17 further comprising:

second conveyor means opposite and spaced from said first conveyor means and opposite said mechanical lifting means for catching a plastic film bag raised by said multiplicity of pins.

* * * * *